US005551129A

United States Patent [19]

Chu

[11] Patent Number: 5,551,129

[45] Date of Patent: Sep. 3, 1996

[54] SLIDER OF A ZIPPER

[76] Inventor: Tino Chu, No. 95, Chien Cheng Street, Chien Cheng, Kaoshiung, Taiwan

[21] Appl. No.: 568,953

[22] Filed: Dec. 7, 1995

[51] Int. Cl.[6] ..... A44B 19/00

[52] U.S. Cl. ..... 24/429; 24/419; 24/437

[58] Field of Search ..... 24/429, 419, 433, 24/437; 294/3.6

[56] References Cited

U.S. PATENT DOCUMENTS

| | | | |
|---|---|---|---|
| 2,974,382 | 3/1961 | Carlile | 24/433 |
| 4,624,032 | 11/1986 | Ishii et al. | 24/437 |
| 4,823,447 | 4/1989 | Akashi | 24/419 |
| 4,982,479 | 1/1991 | Oda | 24/419 |

*Primary Examiner*—Victor N. Sakran
*Attorney, Agent, or Firm*—Bucknam and Archer

[57] ABSTRACT

A slider which includes a slider body having a nose suspending at one side, a front open chamber, and two protrusive flanges bilaterally disposed at the front side of the front open chamber, a spring bolt mounted inside the front open chamber to block the gap between the free end of the nose and the slider body, and a stop block mounted in the front side of the front open chamber and secured in place by the protrusive flanges to hold the spring bolt inside the front open chamber, the spring bolt having a beveled top edge, which permits the pull tap to be inserted through the gap between the free end of the nose and the slider body into engagement with the nose and, which prohibits disconnection of the pull tab from the nose after its installation.

1 Claim, 1 Drawing Sheet

FIG. 1
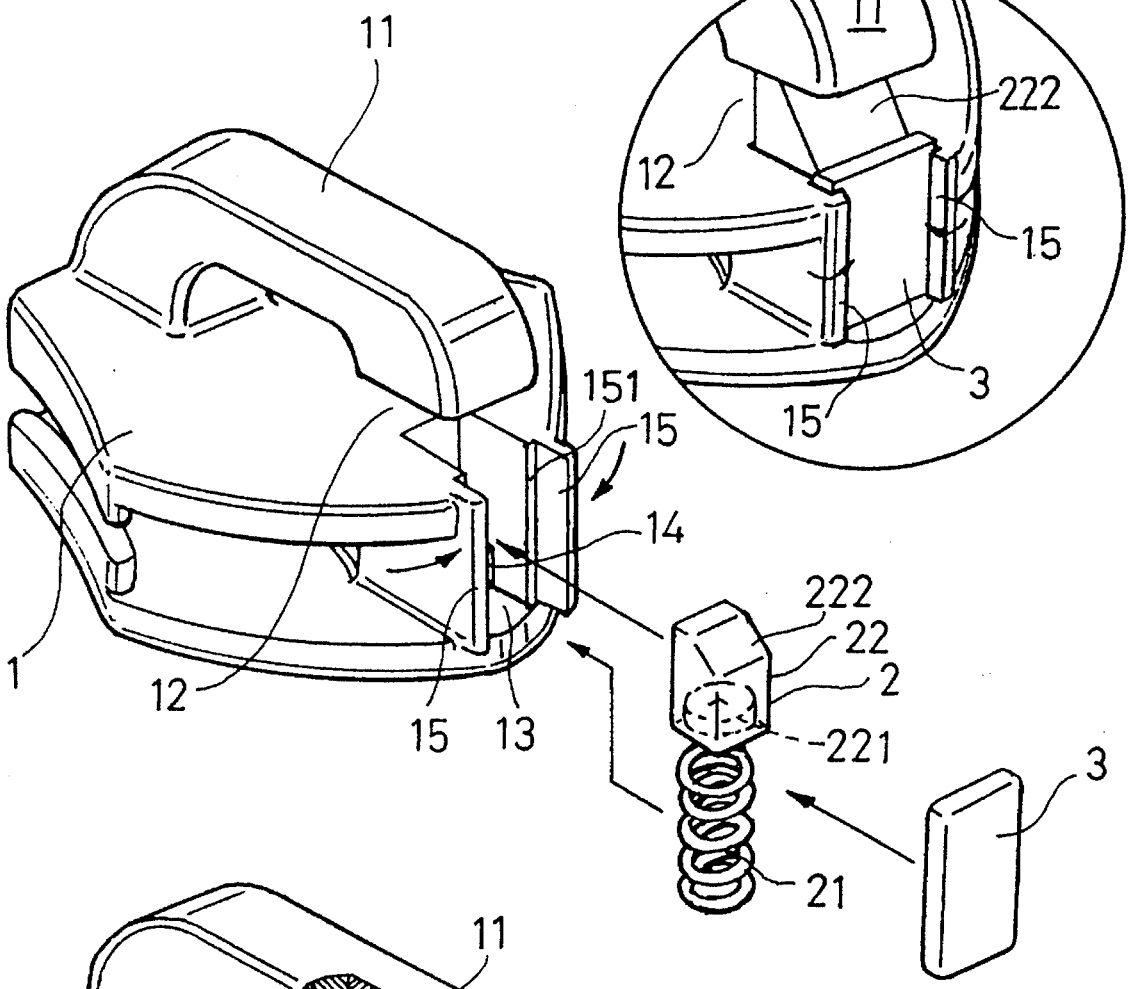
FIG. 2
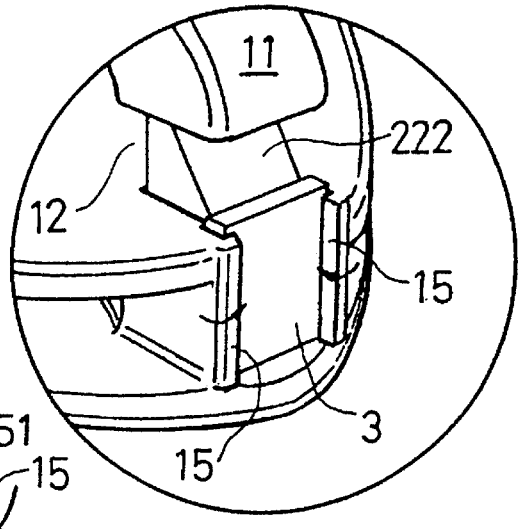
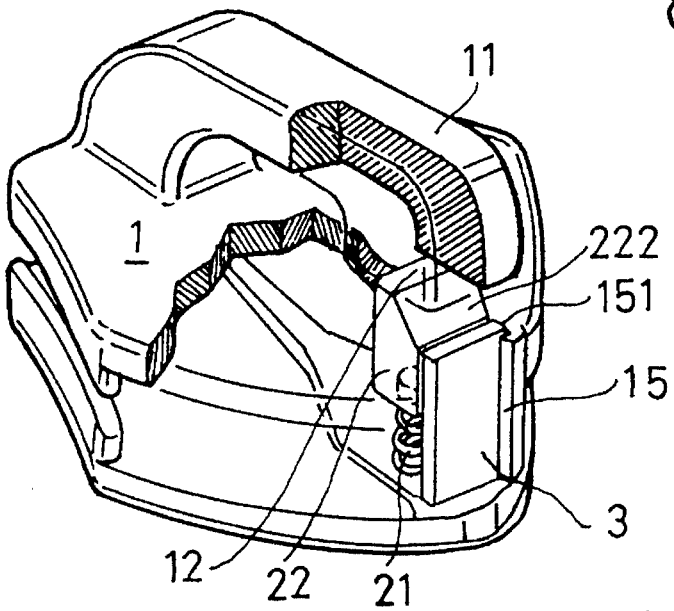
FIG. 3

SLIDER OF A ZIPPER

BACKGROUND OF THE INVENTION

The present invention relates to zippers, and relates more specifically to the slider of a zipper which a spring bolt to releasably block the gap between the suspended nose and the slider body so that the pull tap can be conveniently installed, and will not disconnect from the nose after its installation.

Zippers are widely used to fasten and unfasten two adjoining edges of material, as on the placket of a dress, the fly of a pair of trousers, etc. A zipper is generally comprised of two rows of interlocking teeth, and a slider pulled by a pull tab to lock or unlock the two rows of teeth. The slider has a nose for mounting the pull tab. However, the installation of the pull tab is not easy. When the pull tab is mounted on the nose of the slider, the nose is deformed by a press to secure the pull tab in place. During installation of the pull tab, the body of the slider may be deformed. If the body of the slider is deformed, the rows of teeth cannot be smoothly pass through the sliding way of the slider.

SUMMARY OF THE INVENTION

The present invention has been accomplished to provide a slider which eliminates the aforesaid problems.

According to the preferred embodiment of the present invention, the slider comprises a slide body having a nose suspending at one side, a receiving open chamber at a front end thereof, two protrusive flanges longitudinally forwardly raised from two opposite sides of the receiving open chamber and defining a respective stop edge, and an upright rod disposed inside the receiving open chamber, the nose having a fixed end extending from one side of said slider body and a free end spaced above the receiving open chamber by a gap; a spring bolt mounted inside the receiving open chamber, the spring bolt comprising a spring element mounted around the upright rod, and a bolt supported on the spring element and forced by it to block the gap, the bolt having a beveled top edge for permitting the pull tap to be smoothly inserted through the gap between the free end of the nose and the side wall of the slider body into engagement with the nose; and a stop plate fastened to the stop edge of each protrusive flange and retained in place by the protrusive flanges to stop the spring bolt inside the receiving open chamber.

BRIEF DESCRIPTION OF THE DRAWINGS

FIG. 1 is an exploded view of a slider according to the present invention;

FIG. 2 shows the slider assembled; and

FIG. 3 is a cutaway of the slider according to the present invention.

DETAILED DESCRIPTION OF THE PREFERRED EMBODIMENT

Referring to FIG. 1, a slider in accordance with the present invention is generally comprised of a slider body 1, a spring bolt 2, and a stop plate 3. The slider body 1 is made to pull two rows of teeth between the interlocked position and the unlocked position, having a nose 11 extending from one side. The free end of the nose 11 is spaced from the slider body 1 by a gap 12. A receiving open chamber 13 is made on the slider body 1 below the gap 12. An upright rod 14 is disposed inside the receiving chamber 13. Two protrusive flanges 15 are outwardly raised from two opposite sides of the receiving open chamber 13, defining a respective stop portion 151 at an inner side. The spring bolt 2 comprises a spring element 21 mounted on the upright rod 14 inside the receiving open chamber 13, and a bolt 22 connected to the spring element 21. The bolt 22 has a recessed bottom hole 221 for mounting the spring element 21, and a beveled top edge 222. Through the top beveled top edge 222, the pull tab can be conveniently inserted through the gap 12 into engagement with the nose 11.

Referring to FIGS. 2 and 3, when the spring element 21 is mounted around the upright rod 14 inside the receiving open chamber 13, the bolt 22 protrudes in the gap 12 and stops at the free end of the nose 11. After the installation of the spring bolt 2, the stop plate 3 is inserted in between the two protrusive flanges 15 and stopped at the stop portions 151 to block the front open side of the receiving open chamber 13, then the two protrusive flanges 15 are bend inwards to hold down the stop plate 3. When the stop plate 3 is installed, it does not block the gap 12, and the pull tab can be inserted through the beveled top edge 222 of the bolt 22 of the spring bolt 2 into engagement with the nose 11. When the pull tap is installed, the bolt 22 is automatically forced by the spring element 21 to block the gap 12, and therefore the pull tap cannot be disconnected from the nose 11.

It is to be understood that the drawings are designed for purposes of illustration only, and are not intended as a definition of the limits and scope of the invention disclosed.

I claim:

1. A slider comprising:

a slider body having a nose suspending at one side, a receiving open chamber at a front end thereof, two protrusive flanges longitudinally forwardly raised from two opposite sides of said receiving open chamber and defining a respective stop edge, and an upright rod disposed inside said receiving open chamber, said nose having a fixed end extending from one side of said slider body and a free end spaced above said receiving open chamber by a gap;

a spring bolt mounted inside said receiving open chamber, said spring bolt comprising a spring element mounted around said upright rod, and a bolt supported on said spring element and forced by it to block said gap, said bolt having a beveled top edge for permitting a pull tab to be inserted through said gap into engagement with said nose; and a stop plate fastened to the stop edge of each protrusive flange and retained in place by said protrusive flanges to stop said spring bolt inside said receiving open chamber.

* * * * *